US009034790B2

(12) United States Patent
Chakar et al.

(10) Patent No.: US 9,034,790 B2
(45) Date of Patent: May 19, 2015

(54) THERMALLY-RESPONSIVE RECORD MATERIAL

(71) Applicants: Fadi Selim Chakar, Appleton, WI (US); Mark Robert Fisher, Appleton, WI (US)

(72) Inventors: Fadi Selim Chakar, Appleton, WI (US); Mark Robert Fisher, Appleton, WI (US)

(73) Assignee: Appvion, Inc., Appleton, WI (US)

( * ) Notice: Subject to any disclaimer, the term of this patent is extended or adjusted under 35 U.S.C. 154(b) by 112 days.

(21) Appl. No.: 13/803,824

(22) Filed: Mar. 14, 2013

(65) Prior Publication Data

US 2014/0263665 A1 Sep. 18, 2014

(51) Int. Cl.
*B41M 5/327* (2006.01)
*B41M 5/333* (2006.01)
*B41M 5/337* (2006.01)

(52) U.S. Cl.
CPC ..... *B41M 5/3275* (2013.01); *B41M 5/3336* (2013.01); *B41M 5/3375* (2013.01)

(58) Field of Classification Search
CPC ..... B41M 5/3275; B41M 5/3336; B41M 5/3375; B41M 5/327; B41M 5/333; B41M 5/337
USPC ..... 503/209, 216, 217, 221
See application file for complete search history.

(56) References Cited

U.S. PATENT DOCUMENTS

| | | | | |
|---|---|---|---|---|
| 3,539,375 | A | 11/1970 | Baum | 117/36.2 |
| 3,674,535 | A | 7/1972 | Blose et al. | 117/36.8 |
| 3,681,390 | A | 8/1972 | Lin | 117/36.2 |
| 3,746,675 | A | 7/1973 | Blose et al. | 260/23 |
| 4,151,748 | A | 5/1979 | Baum | 73/356 |
| 4,181,771 | A | 1/1980 | Hanson et al. | 428/327 |
| 4,226,912 | A | 10/1980 | Iwasaki et al. | 428/411 |
| 4,246,318 | A | 1/1981 | Baum | 428/411 |
| 4,330,473 | A | 5/1982 | Hatano et al. | 549/226 |
| 4,470,057 | A | 9/1984 | Glanz | 346/209 |
| 4,510,513 | A | 4/1985 | Yamaguchi et al. | 346/214 |
| 4,521,793 | A | 6/1985 | Kabashima et al. | 346/201 |
| 5,043,312 | A | 8/1991 | Hiraishi et al. | 503/208 |
| 5,043,315 | A | 8/1991 | Sekine et al. | 503/217 |
| 5,079,211 | A | 1/1992 | Shimura et al. | 503/217 |
| 5,106,814 | A | 4/1992 | Hiraishi et al. | 503/208 |
| 5,208,208 | A | 5/1993 | Motoda et al. | 503/208 |
| 5,288,688 | A | 2/1994 | Kawakami et al. | 503/217 |
| 5,464,804 | A | 11/1995 | Kawakami et al. | 503/217 |
| 5,470,816 | A | 11/1995 | Satake et al. | 503/201 |

FOREIGN PATENT DOCUMENTS

| | | | | |
|---|---|---|---|---|
| JP | 06-191154 | * | 7/1994 | B41M 5/26 |

* cited by examiner

*Primary Examiner* — Bruce H Hess
(74) *Attorney, Agent, or Firm* — Benjamin Mieliulis

(57) ABSTRACT

The invention describes a thermally-responsive record material substantially free of aromatic isocyanate. The record material comprises a support having provided thereon a heat-sensitive composition comprising a substantially colorless dye precursor comprising a fluoran; and a developer material selected from the group consisting of 4,4'-diaminodiphenylsulfone and 3,3'-diaminodiphenylsulfone, which upon being heated react with said dye precursor to develop color, and including a binder material. Optionally, a modifier compound is included in the heat-sensitive composition. The modifier compound can be selected from the group consisting of a fatty acid amide, preferably a saturated fatty acid amide such as an alkyl amide, a bis methylene alkyl amide, or a bis ethylene alkyl amide, or any of 1,2-diphenoxy ethane, dimethyl diphenoxy ethane, and dimethyl phthalate.

6 Claims, No Drawings

THERMALLY-RESPONSIVE RECORD MATERIAL

FIELD OF THE INVENTION

This invention relates to a thermally-responsive record material. It more particularly relates to such record material of the type in the form of sheets coated with color-forming systems comprising chromogenic material (electron-donating dye precursors) and typically acidic color developer material. This invention particularly concerns a thermally-responsive record material capable of forming a substantially non-reversible image resistant to fade or erasure and useful for producing dark images or functional bar codes. The invention teaches an improved thermally-sensitive record material which when imaged exhibit useful image properties.

DESCRIPTION OF THE RELATED ART

Thermally-responsive record material systems are well known in the art and are described in many patents, for example. U.S. Pat. No. 3,539,375 Baum; U.S. Pat. No. 3,674,535 Blose et al., U.S. Pat. No. 3,746,675 Blose et al., U.S. Pat. No. 4,151,748 Baum; 4,181,771 Hanson et al,; U.S. Pat. No. 4,246,318 Baum, and U.S. Pat. No. 4,470,057 Glanz which are incorporated herein by reference. In these systems, basic colorless or lightly colored chromogenic material and acidic color developer material are contained in a coating on a substrate which, when heated to a suitable temperature, melts or softens to permit said materials to react, thereby producing a colored mark.

Thermally-responsive record materials have characteristic thermal response, desirably producing a colored image of sufficient intensity upon selective thermal exposure.

A need exists in the industry for thermally responsive record materials that are considered more environmentally friendly. A thermally-imaging formulation that can produce an image when heated to a suitable temperature and be more acceptable in the marketplace from environmental or safety considerations would be useful commercially.

Thermally-responsive record materials are utilized in diverse application including for labeling, facsimile, point of sale printing, printing of tags, pressure sensitive labels.

Kawakami, U.S. Pat. No. 5,464,804 teaches a thermal recording material wherein colorless dye is combined with an isocyanate and an amino compound Similarly Shimura et al., U.S. Pat. No. 5,079,211 teaches forming a heat sensitive recording material by combining a fluoran compound with an aromatic isocyanate and an imino compound having at least one >C═NH which reacts with the isocyanate compound upon application of heat to form a color.

Shimura's isocyanate compounds are aromatic or heterocyclic isocyanate compounds such as also disclosed in Kabashima et al., U.S. Pat. No. 4,521,793. An aromatic isocyanate is reacted with an imino compound having at least one >C═NH group to effect color formation. In each case the isocyanate is reacted with the imino compound to form a complex that reacts with the dye.

The present invention is a departure from preceding art by foregoing the use of isocyanate materials. Isocyanates are disfavored in some environments and can even be hazardous. A thermally imaging system substantially-free of isocyanate would be commercially useful. Additionally the present invention advantageously provides an alternative to the typical phenolic developer common employed.

DETAILED DESCRIPTION

The invention teaches the use of a combination of non-phenolic developers for thermal sensitive recording materials. More specifically, this invention relates to using 4,4'-diaminodiphenyl sulfone and 3,3'-diaminodiphenyl sulfone and/or a mixture of both developers and a leuco dye.

The invention describes a thermally-responsive record material substantially free of aromatic isocyanate. The record material comprises a support having provided thereon a heat-sensitive composition comprising a substantially colorless dye precursor comprising a fluoran; and a developer material, preferably the developer material is selected from the group consisting of 4,4'-diaminodiphenylsulfone and 3,3'-diaminodiphenylsulfone, which upon being heated reacts with said dye precursor to develop color, and including a binder material. Optionally, but preferably, modifier compound can be employed. The modifier compound is preferably selected from the group consisting of a fatty acid amide, 1,2-diphenoxy ethane, dimethyl diphenoxy ethane, and dimethyl phthalate can be employed. A fatty acid amide is more preferred.

In a further embodiment the invention comprises a thermally-responsive record material, wherein the substantially colorless dye precursor comprises a fluoran compound of the formula

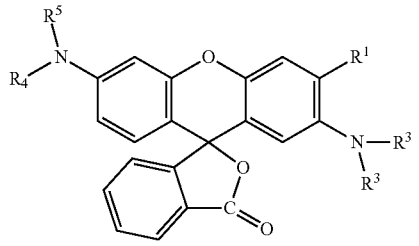

wherein $R_1$ is hydrogen or alkyl wherein $R_2$ is hydrogen or alkaryl;

wherein $R_3$ is aryl when $R_2$ is hydrogen, or alkaryl when $R_2$ is alkaryl;

$R_4$ and $R_5$ are each independently selected from alkyl, aralkyl; or $R_4$ and $R_5$ form a four carbon ring pyrrolidine structure.

In a yet further embodiment, in the thermally-responsive record material described the fluoran is selected from the group consisting of:

1

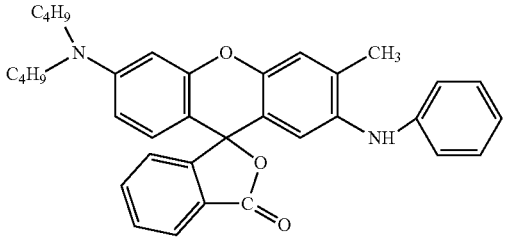

-continued

2

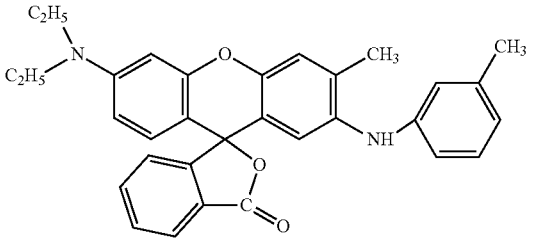

3

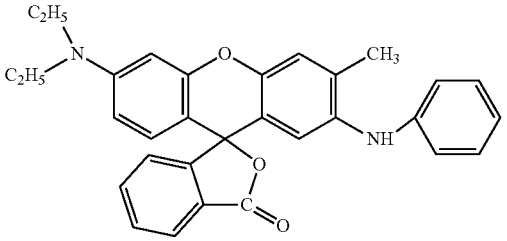

4

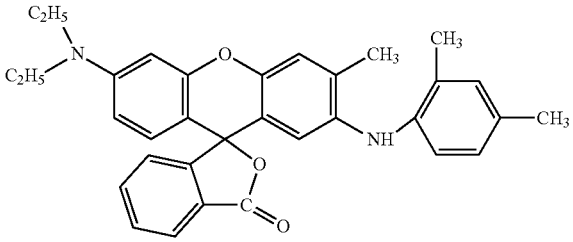

5

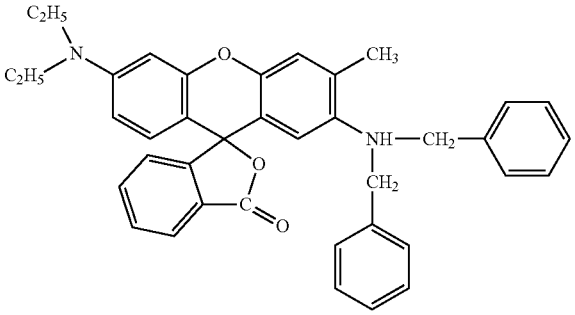

6

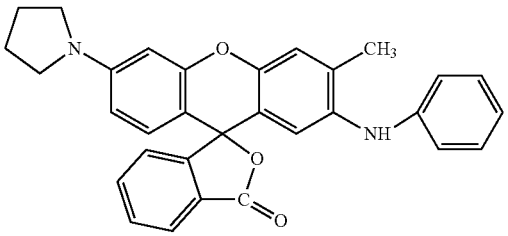

7

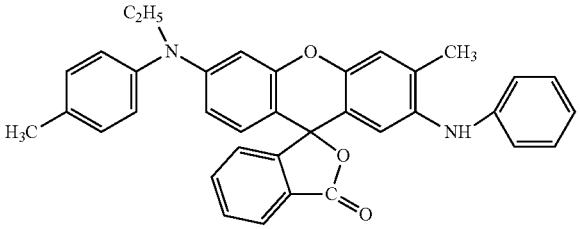

For convenience, the above dye precursors are referred to herein as the respective "dye," by the structure number (e.g. "dye 1," "dye 2," "dye 3," "dye 4," "dye 5," "dye 6," and "dye 7."

In a yet further embodiment the thermal modifier compound is a saturated fatty acid amide or bisamide.

In a yet further embodiment, in the thermally-responsive record material the thermal modifier compound is a fatty acid amide, and preferably the modifier compound is a fatty acid amide selected from

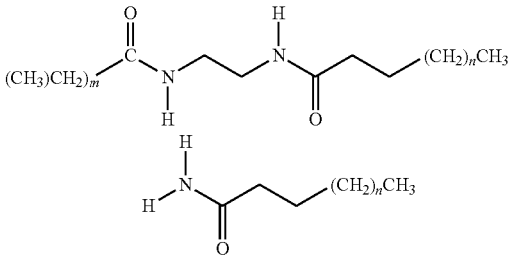

wherein m is 1 to 23, n is 0 to 21.

The fatty acid amides useful in the invention can include lauramide, myristamide, palmitamide, or stearamide.

Preferably the amide alkyl length is anywhere from four to 24 carbons, or even from 4 to 18 carbons, or even from 8 to 22 carbons. Each respective alkyl length in the bisamide or diamide can be similar as in the monoamide in terms of carbon number. Optionally the amide is a bisamide of preferably of 8 to 48 carbons, or even from 4 to 24 carbons, or even from 8 to 36 carbons.

The fatty acid bisamide can even include methylene bisamides such as methylene bis stearamide, or ethylene bisamides such as ethylene bis lauric acid amide, $N_1$N-ethylene bis(stearamide), 1,2-bis(octanamido)ethane, 1,2-bis(hexanamido)ethane or $N_1$N-ethylenebis(palmitamide).

The record material according to the invention has a non-reversible image in that it is non-reversible under the action of heat. The coating of the record material of the invention is basically a dewatered solid at ambient temperature.

The color-forming system of the record material of this invention comprises the electron donating dye precursors, also known as chromogenic material, in its substantially colorless state together with an acidic developer material. The color-forming system relies upon melting, softening, or subliming one or more of the components to achieve reactive, color-producing contact with the chromogen. Substantially colorless for purposes of the invention is understood to mean colorless or lightly or faintly colored.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparative small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention resides in the color-forming composition coated on the substrate. The kind or type of substrate material is not critical. In some embodiments neutral sized base paper is a preferred substrate.

The components of the heat sensitive coating are in substantially contiguous relationship, substantially homogeneously distributed throughout the coated layer or layers deposited on the substrate. For purposes of this invention the term substantially contiguous is understood to mean that the color-forming components are positioned in sufficient proximity such that upon melting, softening or subliming one or more of the components, a reactive color-forming contact between the components is achieved. As is readily apparent to the person of ordinary skill in this art, these reactive components accordingly can be in the same coated layer or layers, or individual components positioned in separate layers using multiple layers. In other words, one component can be positioned in the first layer, and developer or modifier or sensitizer components positioned in a subsequent layer or layers. All such arrangements are understood herein as being substantially contiguous.

The developer to dye precursor ratio by weight is maintained, at from 1:1 to about 4:1, or even from 0.1:1 to about 3:1, or even from 0.5:1 to about 2.5:1 or even from about 0.5:1 to about 5:1. Preferably the developer to dye precursor ratio is from about 1:1 to about 3:1. The modifier to dye precursor ratio by weight is preferably maintained at greater than 1:1, or even from 0.2:1 to about 2.5:1, or even from about 0.1:1 to about 3:1, or even from 0.1:1 to about 4:1.

In manufacturing the record material, a coating composition is prepared which includes a fine dispersion of the components of the color-forming system, and binder material, preferably polymeric binder such as polyvinyl alcohol. The composition of the invention can optionally include or be free of pigments including clays and fillers. Preferably, pigments, if included, are maintained at less than 13%, or even less than 20%, or even less than 30%, by weight of the heat sensitive coating composition of the invention.

The heat-sensitive coating composition can additionally contain pigments, such as clay, talc, silicon dioxide, aluminum hydroxide, calcined kaolin clay and calcium carbonate, and urea-formaldehyde resin pigments at from 0 to 10% or even from 0 to 20% or even 0 to 30% by weight of the heat-sensitive coating. Other optional materials include natural waxes, Carnauba wax, synthetic waxes, lubricants such as zinc stearate; wetting agents; defoamers, modifiers and antioxidants. The modifier typically does not impart any image on its own but as a relatively low melt point solid, acts as a solvent to facilitate reaction between the mark-forming components of the color-forming system. Optionally the thermally-sensitive record material can be top coated with a polymeric material forming a top coating. Materials such as polyvinyl alcohol or any of various binder materials can also be used for this purpose.

The color-forming system components are substantially insoluble in the dispersion vehicle (preferably water) and are ground to an individual average particle size of less than 10 microns, preferably less than 3 microns. The polymeric binder material is substantially vehicle soluble although latexes are also eligible in some instances. Preferred water soluble binders, which can also be used as topcoats, include polyvinyl alcohol, hydroxy ethylcellulose, methylcellulose, methyl-hydroxypropylcellulose, starch, modified starches, gelatin and the like. Eligible latex materials for the binder and/or topcoat include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 1 to about 9 grams per square meter (gsm) or even from 0.5 to about 10 gsm and preferably about 3 to about 6 gsm and more preferably from 3 to 5 gsm. The practical amount of color-forming materials is controlled by economic considerations, functional parameters and desired handling characteristics of the coated sheets.

The thermally response record material of the invention is particularly advantageous for bar codes. Bar codes provide a convenient means for computerized inventory or goods handling and tracking. To function properly, it is necessary that the bar code have high print contrast signal, and that the thermally-responsive material on which the bar code is imaged resist unwanted bar width growth after imaging. The characters or bars must not only be intensely imaged, but must be sharp, and unbroken or free of pin holes. It is also necessary that when read by a scanner that a high percentage of scans result in successful decoding of the information in the bar code. The percentage of successful decodes of the bar code information must be maintained at a high value for the thermally-responsive record material to gain wide commercial acceptance for use in bar coding applications.

To form a bar code, the heat sensitive layer on the support is imaged by selective application of heat in the pattern of a bar code. The thermally responsive record material composition described herein enables imaging on the record material of an improved bar code of any type, including one and two dimension pattern bar codes. Bar codes are well known and typically comprise a plurality of uniformly spaced apart parallel vertical lines, often of differing thicknesses forming a row extending from a common horizontal axis. The horizontal axis is generally not shown but is a convenient reference point for descriptive purposes. The spaced apart parallel neutral lines are arranged in a row. Bar codes are a machine readable representation of data and can be one dimension or two dimension patterns, graphics, or other imaged patterns relying on interpretive software to decode the bar code when scanned.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component can be prepared by milling the component in an aqueous solution of the binder until a particle size of less than 10 microns is achieved. The milling was accomplished in an attritor or other suitable milling device. The desired average particle size was less than 3 microns in each dispersion.

The thermally-responsive sheets were made by making separate dispersions of chromogenic material, modifier material, and developer material. The dispersions are mixed in the desired ratios and applied to a support with a wire wound rod and dried. Other materials such as fillers, antioxidants, lubricants and waxes can be added if desired. The sheets may be calendered to improve smoothness.

The abbreviations and dye precursor numbers correspond to the following materials:

| | |
|---|---|
| DME | dimethyldiphenoxyethane |
| DPE | 1,2-diphenoxyethane |
| DMT | dimethyl phthalate |

-continued

| Dye, Formula # | |
|---|---|
| Dye 1 | 3-diethylamino-6-methyl1-7-(2',4'dimethyl aniline) fluoran |
| Dye 2 | 3-dibutylamino-6-methyl-7-anilino fluoran |
| Dye 3 | 3-diethylamino-6-methyl-7-(3'-methylanilino) fluoran |
| Dye 4 | 3-diethylamino-6-methyl-7-anilinofluoran |
| Dye 5 | 3-(N-ethyl-N-p-tolylamino)-6-methyl-y-anilino fluoran |
| Dye 6 | 3-pyrrolidino-6-methyl-7-anilino fluoran |
| Dye 7 | 3-diethylamino-7-(dibenzylamino) fluoran |
| Selvol 125, Sekisui Chemical Co., Ltd., Tokyo, Japan | Polyvinyl alcohol |

Chromogenic (Dye Precursor) Dispersions

| Material | Parts |
|---|---|
| DISPERSION A - CHROMOGENIC MATERIAL | |
| Chromogenic material | 34.0 |
| Binder, 20% solution of Polyvinyl alcohol | 27.0 |
| Dispersing and defoaming agents | 4.0 |
| Water | 35.0 |
| Dispersion A1 - Chromogenic material is Dye 1 | |
| Dispersion A2 - Chromogenic material is Dye 2 | |
| Dispersion A3 - Chromogenic material is Dye 3 | |
| Dispersion A4 - Chromogenic material is Dye 4 | |
| Dispersion A5 - Chromogenic material is Dye 5 | |
| Dispersion A6 - Chromogenic material is Dye 6 | |
| Dispersion A7 - Chromogenic material is Dye 7 | |
| DISPERSION B - DEVELOPER MATERIAL | |
| Acidic Material | 39.0 |
| Binder, 20% solution of Polyvinyl alcohol | 24.0 |
| Dispersing and defoaming agents | 0.5 |
| Water | 36.5 |
| Dispersion B1 - developer material is 4,4'-diaminodiphenyl sulfone | |
| Dispersion B2 - developer material is 3,3'-diaminodiphenyl sulfone | |
| DISPERSION C - MODIFIER MATERIAL | |
| Modifier Material | 25.0 |
| Binder, 20% solution of Polyvinylalcohol | 20.0 |
| Dispersing and defoaming agents | 1.0 |
| Water | 54.0 |
| Dispersion C1 - modifier material is DPE | |
| Dispersion C2 - modifier material is DME | |
| Dispersion C3 - modifier material is DMT | |
| Dispersion C4 - modifier material is stearamide wax | |

| | Parts (by weight) |
|---|---|
| Coating Formulation I. | |
| Dispersion A (chromogen) | 4.0 |
| Dispersion B (developer) | 15.0 |
| Binder, 10% solution of polyvinyl alcohol | 13.0 |
| Filler slurry, 30% in water | 1.0 |
| Filler slurry, 21% in water | 24.0 |
| Additives (rheology modifier, lubricant, optical brightener) | 2.0 |
| Water | 41.0 |
| Coating Formulation II | |
| Dispersion A (chromogen) | 4.0 |
| Dispersion B (developer) | 15.0 |
| Dispersion C (modifier) | 3.0 |
| Binder, 10% solution of polyvinyl alcohol | 13.0 |
| Filler slurry, 30% in water | 1.0 |
| Filler slurry, 21% in water | 24.0 |
| Additives (rheology modifier, lubricant, optical brightener) | 2.0 |
| Water | 38.0 |

LIST OF EXAMPLES

Example 1

Coating Formulation I Using

Dispersion A1 (Dye 1)
Dispersion B1 (4,4'-diaminodiphenyl sulfone)

Example 2

Coating Formulation I Using

Dispersion A1 (Dye 1)
Dispersion B2 (3,3'-diaminodiphenyl sulfone)

Example 3

Coating Formulation I Using

Dispersion A2 (Dye 2)
Dispersion B1 (4,4'-diaminodiphenyl sulfone)

Example 4

Coating Formulation I Using

Dispersion A2 (Dye 2)
Dispersion B2 (3,3'-diaminodiphenyl sulfone)

Example 5

Coating Formulation I Using

Dispersion A3 (Dye 3)
Dispersion B1 (4,4'-diaminodiphenyl sulfone)

Example 6

Coating Formulation I Using

Dispersion A3 (Dye 3)
Dispersion B2 (3,3'-diaminodiphenyl sulfone)

Example 7

Coating Formulation I Using

Dispersion A4 (Dye 4)
Dispersion B1 (4,4'-diaminodiphenyl sulfone)

Example 8

Coating Formulation I Using

Dispersion A4 (Dye 4)
Dispersion B2 (3,3'-diaminodiphenyl sulfone)

Example 9

Coating Formulation I Using

Dispersion A5 (Dye 5)
Dispersion B1 (4,4'-diaminodiphenyl sulfone)

Example 10

Coating Formulation I Using

Dispersion A5 (Dye 5)
Dispersion B2 (3,3'-diaminodiphenyl sulfone)

Example 11

Coating Formulation I Using

Dispersion A6 (Dye 6)
Dispersion B1 (4,4'-diaminodiphenyl sulfone)

Example 12

Coating Formulation I Using

Dispersion A6 (Dye 6)
Dispersion B2 (3,3'-diaminodiphenyl sulfone)

Example 13

Coating Formulation I Using

Dispersion A7 (Dye 7)
Dispersion B1 (4,4'-diaminodiphenyl sulfone)

Example 14

Coating Formulation I Using

Dispersion A7 (Dye 7)
Dispersion B2 (3,3'-diaminodiphenyl sulfone)

Example 15

Coating Formulation II Using

Dispersion A1 (Dye 1)
Dispersion B1 (4,4'-diaminodiphenyl sulfone)
Dispersion C1 (DPE)

Example 16

Coating Formulation II Using

Dispersion A1 (Dye 1)
Dispersion B1 (4,4'-diaminodiphenyl sulfone)
Dispersion C2 (DME)

Example 17

Coating Formulation II Using

Dispersion A1 (Dye 1)
Dispersion B1 (4,4'-diaminodiphenyl sulfone)
Dispersion C3 (DMT)

Example 18

Coating Formulation II Using

Dispersion A1 (Dye 1)
Dispersion B1 (4,4'-diaminodiphenyl sulfone)
Dispersion C4 (Stearamide wax)

Example 19

Coating Formulation II Using

Dispersion A1 (Dye 1)
Dispersion B2 (3,3'-diaminodiphenyl sulfone)
Dispersion C1 (DPE)

Example 20

Coating Formulation II Using

Dispersion A1 (Dye 1)
Dispersion B2 (3,3'-diaminodiphenyl sulfone)
Dispersion C2 (DME)

Example 21

Coating Formulation II Using

Dispersion A1 (Dye 1)
Dispersion B2 (3,3'-diaminodiphenyl sulfone)
Dispersion C3 (DMT)

Example 22

Coating Formulation II Using

Dispersion A1 (Dye 1)
Dispersion B2 (3,3'-diaminodiphenyl sulfone)
Dispersion C4 (stearamide wax)

Example 23

Coating Formulation II Using

Dispersion A2 (Dye 2)
Dispersion B1 (4,4'-diaminodiphenyl sulfone)
Dispersion C1 (DPE)

Example 24

Coating Formulation II Using

Dispersion A2 (Dye 2)
Dispersion B1 (4,4'-diaminodiphenyl sulfone)
Dispersion C2 (DME)

Example 25

Coating Formulation II Using

Dispersion A2 (Dye 2)
Dispersion B1 (4,4'-diaminodiphenyl sulfone)
Dispersion C3 (DMT)

Example 26

Coating Formulation II Using

Dispersion A2 (Dye 2)
Dispersion B1 (4,4'-diaminodiphenyl sulfone)
Dispersion C4 (stearamide wax)

Example 27

Coating Formulation II Using

Dispersion A2 (Dye 2)
Dispersion B2 (3,3'-diaminodiphenyl sulfone)
Dispersion C1 (DPE)

Example 28

Coating Formulation II Using

Dispersion A2 (Dye 2)
Dispersion B2 (3,3'-diaminodiphenyl sulfone)
Dispersion C2 (DME)

Example 29

Coating Formulation II Using

Dispersion A2 (Dye 2)
Dispersion B2 (3,3'-diaminodiphenyl sulfone)
Dispersion C3 (DMT)

Example 30

Coating Formulation II Using

Dispersion A2 (Dye 2)
Dispersion B2 (3,3'-diaminodiphenyl sulfone)
Dispersion C4 (stearamide wax)

Example 31

Coating Formulation II Using

Dispersion A3 (Dye 3)
Dispersion B1 (4,4'-diaminodiphenyl sulfone)
Dispersion C1 (DPE)

Example 32

Coating Formulation II Using

Dispersion A3 (Dye 3)
Dispersion B1 (4,4'-diaminodiphenyl sulfone)
Dispersion C2 (DME)

Example 33

Coating Formulation II Using

Dispersion A3 (Dye 3)
Dispersion B1 (4,4'-diaminodiphenyl sulfone)
Dispersion C3 (DMT)

Example 34

Coating Formulation II Using

Dispersion A3 (Dye 3)
Dispersion B1 (4,4'-diaminodiphenyl sulfone)
Dispersion C4 (stearamide wax)

Example 35

Coating Formulation II Using

Dispersion A3 (Dye 3)
Dispersion B2 (3,3'-diaminodiphenyl sulfone)
Dispersion C1 (DPE)

Example 36

Coating Formulation II Using

Dispersion A3 (Dye 3)
Dispersion B2 (3,3'-diaminodiphenyl sulfone)
Dispersion C2 (DME)

Example 37

Coating Formulation II Using

Dispersion A3 (Dye 3)
Dispersion B2 (3,3'-diaminodiphenyl sulfone)
Dispersion C3 (DMT)

Example 38

Coating Formulation II Using

Dispersion A3 (Dye 3)
Dispersion B2 (3,3'-diaminodiphenyl sulfone)
Dispersion C4 (stearamide wax)

Example 39

Coating Formulation II Using

Dispersion A4 (Dye 4)
Dispersion B1 (4,4'-diaminodiphenyl sulfone)
Dispersion C1 (DPE)

Example 40

Coating Formulation II Using

Dispersion A4 (Dye 4)
Dispersion B1 (4,4'-diaminodiphenyl sulfone)
Dispersion C2 (DME)

Example 41

Coating Formulation II Using

Dispersion A4 (Dye 4)
Dispersion B1 (4,4'-diaminodiphenyl sulfone)
Dispersion C3 (DMT)

Example 42

Coating Formulation II Using

Dispersion A4 (Dye 4)
Dispersion B1 (4,4'-diaminodiphenyl sulfone)
Dispersion C4 (stearamide wax)

Example 43

Coating Formulation II Using

Dispersion A4 (Dye 4)
Dispersion B2 (3,3'-diaminodiphenyl sulfone)
Dispersion C1 (DPE)

Example 44

Coating Formulation II Using

Dispersion A4 (Dye 4)
Dispersion B2 (3,3'-diaminodiphenyl sulfone)
Dispersion C2 (DME)

Example 45

Coating Formulation II Using

Dispersion A4 (Dye 4)
Dispersion B2 (3,3'-diaminodiphenyl sulfone)
Dispersion C3 (DMT)

Example 46

Coating Formulation II Using

Dispersion A4 (Dye 4)
Dispersion B2 (3,3'-diaminodiphenyl sulfone)
Dispersion C4 (stearamide wax)

Example 47

Coating Formulation II Using

Dispersion A5 (Dye 5)
Dispersion B1 (4,4'-diaminodiphenyl sulfone)
Dispersion C1 (DPE)

Example 48

Coating Formulation II Using

Dispersion A5 (Dye 5)
Dispersion B1 (4,4'-diaminodiphenyl sulfone)
Dispersion C2 (DME)

Example 49

Coating Formulation II Using

Dispersion A5 (Dye 5)
Dispersion B1 (4,4'-diaminodiphenyl sulfone)
Dispersion C3 (DMT)

Example 50

Coating Formulation II Using

Dispersion A5 (Dye 5)
Dispersion B1 (4,4'-diaminodiphenyl sulfone)
Dispersion C4 (stearamide wax)

Example 51

Coating Formulation II Using

Dispersion A5 (Dye 5)
Dispersion B2 (3,3'-diaminodiphenyl sulfone)
Dispersion C1 (DPE)

Example 52

Coating Formulation II Using

Dispersion A5 (Dye 5)
Dispersion B2 (3,3'-diaminodiphenyl sulfone)
Dispersion C2 (DME)

Example 53

Coating Formulation II Using

Dispersion A5 (Dye 5)
Dispersion B2 (3,3'-diaminodiphenyl sulfone)
Dispersion C1 (DPE)
Dispersion C3 (DMT)

Example 54

Coating Formulation II Using

Dispersion A5 (Dye 5)
Dispersion B2 (3,3'-diaminodiphenyl sulfone)
Dispersion C4 (stearamide wax)

Example 55

Coating Formulation II Using

Dispersion A6 (Dye 6)
Dispersion B1 (4,4'-diaminodiphenyl sulfone)
Dispersion C1 (DPE)

Example 56

Coating Formulation II Using

Dispersion A6 (Dye 6)
Dispersion B1 (4,4'-diaminodiphenyl sulfone)
Dispersion C2 (DME)

Example 57

Coating Formulation II Using

Dispersion A6 (Dye 6)
Dispersion B1 (4,4'-diaminodiphenyl sulfone)
Dispersion C3 (DMT)

Example 58

Coating Formulation II Using

Dispersion A6 (Dye 6)
Dispersion B1 (4,4'-diaminodiphenyl sulfone)
Dispersion C4 (stearamide wax)

Example 59

Coating Formulation II Using

Dispersion A6 (Dye 6)
Dispersion B2 (3,3'-diaminodiphenyl sulfone)
Dispersion C1 (DPE)

Example 60

Coating Formulation II Using

Dispersion A6 (Dye 6)
Dispersion B2 (3,3'-diaminodiphenyl sulfone)
Dispersion C2 (DME)

Example 61

Coating Formulation II Using

Dispersion A6 (Dye 6)
Dispersion B2 (3,3'-diaminodiphenyl sulfone)
Dispersion C3 (DMT)

Example 62

Coating Formulation II Using

Dispersion A6 (Dye 6)
Dispersion B2 (3,3'-diaminodiphenyl sulfone)
Dispersion C4 (stearamide wax)

Example 63

Coating Formulation II Using

Dispersion A7 (Dye 7)
Dispersion B1 (4,4'-diaminodiphenyl sulfone)
Dispersion C1 (DPE)

Example 64

Coating Formulation II Using

Dispersion A7 (Dye 7)
Dispersion B1 (4,4'-diaminodiphenyl sulfone)
Dispersion C2 (DME)

Example 65

Coating Formulation II Using

Dispersion A7 (Dye 7)
Dispersion B1 (4,4'-diaminodiphenyl sulfone)
Dispersion C3 (DMT)

Example 66

Coating Formulation II Using

Dispersion A7 (Dye 7)
Dispersion B1 (4,4'-diaminodiphenyl sulfone)
Dispersion C4 (stearamide wax)

Example 67

Coating Formulation II Using

Dispersion A7 (Dye 7)
Dispersion B2 (3,3'-diaminodiphenyl sulfone)
Dispersion C1 (DPE)

Example 68

Coating Formulation II Using

Dispersion A7 (Dye 7)
Dispersion B2 (3,3'-diaminodiphenyl sulfone)
Dispersion C2 (DME)

Example 69

Coating Formulation II Using

Dispersion A7 (Dye 7)
Dispersion B2 (3,3'-diaminodiphenyl sulfone)
Dispersion C3 (DMT)

Example 70

Coating Formulation II Using

Dispersion A7 (Dye 7)
Dispersion B2 (3,3'-diaminodiphenyl sulfone)
Dispersion C4 (stearamide wax)

TABLE 1

| EXAMPLE | STATUS |
|---|---|
| 1 | IMAGED (1.7; C) |
| 2 | IMAGED (0.2; F) |
| 3 | IMAGED (2.1; C) |
| 4 | IMAGED (1.7; C) |
| 5 | IMAGED (2.4; C) |
| 6 | IMAGED (1.0; D) |
| 7 | IMAGED (2.1; C) |
| 8 | — |
| 9 | PASS (2.5; B) |
| 10 | — |
| 11 | PASS (2.7; B) |
| 12 | — |
| 13 | IMAGED (0.0; F) |
| 14 | IMAGED (0.0; F) |
| 15 | IMAGED (1.7; C0 |
| 16 | IMAGED (1.0; D) |
| 17 | IMAGED (1.6; C) |
| 18 | IMAGED(1.8; C) |
| 19 | IMAGED(0.0; F) |
| 20 | IMAGED (0.0; F) |
| 21 | IMAGED (0.0; F) |
| 22 | IMAGED (1.3; D) |
| 23 | PASS (2.5; B) |
| 24 | PASS (2.6; B) |
| 25 | PASS (2.5; B) |
| 26 | PASS (2.6; B) |
| 27 | IMAGED (1.5; C) |
| 28 | IMAGED (1.4; D) |
| 29 | IMAGED (1.7; C) |
| 30 | IMAGED (2.2; C) |
| 31 | IMAGED (2.1; C) |
| 32 | IMAGED (1.9; C) |
| 33 | IMAGED (1.7; C) |
| 34 | IMAGED (2.2; C) |
| 35 | IMAGED (0.5; D) |
| 36 | IMAGED (0.1; F) |
| 37 | IMAGED (1.0; D) |
| 38 | IMAGED (1.8; C) |
| 39 | IMAGED (2.2; C) |
| 40 | IMAGED (2.1; C) |
| 41 | IMAGED (2.1; C) |
| 42 | PASS (2.5; B) |
| 43 | IMAGED(1.7; C) |
| 44 | IMAGED (1.4; D) |
| 45 | IMAGED (2.0; C) |
| 46 | IMAGED (2.2; C) |
| 47 | PASS (2.6; B) |
| 48 | PASS (2.6; B) |
| 49 | PASS (2.6; B) |
| 50 | PASS (2.7; B) |
| 51 | IMAGED (1.7; C) |
| 52 | IMAGED (1.8; C) |
| 53 | IMAGED (1.8; C) |
| 54 | IMAGED (2.4; C) |
| 55 | PASS (2.5; B) |
| 56 | IMAGED (2.4; C) |
| 57 | PASS (2.5; B) |
| 58 | PASS(2.7; B) |
| 59 | IMAGED (2.3; C) |
| 60 | IMAGED (1.6; C) |
| 61 | IMAGED (2.0; C) |
| 62 | PASS (2.5; B) |
| 63 | IMAGED (0.0; F) |
| 64 | IMAGED (0.0; F) |
| 65 | IMAGED (1.6; C) |
| 66 | IMAGED (0.0; F) |
| 67 | IMAGED (0.0; F) |
| 68 | IMAGED (0.0; F) |
| 69 | IMAGED (0.0; F) |
| 70 | IMAGED (0.0; F) |

Tabulated Results of Examples 1-70

Examples 1-70 were prepared at a weight of coat of 3.5#/3300 ft^2' (1588 g/307 sq. meters) (5.17 g/sq. meter)

Samples from the examples were imaged using an Atlantek 400 at a medium energy setting. Barcodes were scanned using a TRUCHECK verifier at 650 nm wavelength. Barcode quality was assessed in accordance with ANSI's (American National Standards Institute) "Bar Code Print Quality Guideline", X3.182 published in 1990. The output of the ANSI method is a grade for any barcode on a scale of 0.0 to 4.0. It is also expressed as a letter grade A, B, C, D, and F based on measurements in each category. A grade of C or better generally scans with properly maintained scanners on a first pass.

TABLE 2

| CONVERSION OF SYMBOL AVERAGE TO SYMBOL GRADE |
|---|
| 3.5 <= A <= 4.0 |
| 2.5 <= B < 3.5 |
| 1.5 <= C < 2.5 |
| 0.5 <= D < 1.5 |
| F < 0.5 |

Often the marketplace will specify grade B or higher grade bar codes for labels and receipts to allow a extra margin of error to minimize misread barcodes.

In the current invention, we rate a system as PASS if a barcode scans with an ANSI grade B or better. Systems rated "PASS" not only image but are also consistently scannable. We also rate a system as IMAGED if a barcode scans with an ANSI grade of C or lower but an image is visually perceivable.

Test Method

A thermally imaged barcode was formed and scanned with a TRUECHECK VERIFIER at 650 nm.

Scannability is defined in accordance with ANSI's "Bar Code Print Quality Guide," X3.182 published in 1990. In this invention we define a barcode as scannable if the overall ANSI grade is a B or better.

In this test we define a barcode as fail if the overall ANSI grade is a C or lower. Although a barcode receiving a failing grade can still scan if rated C or better in well maintained equipment in the market place, systems rated as B are expected to perform adequately over a range of equipment.

In this test, even if the bar code fails, the thermal image may still be legible to the human eye although susceptible to higher incidences of scanner misreads.

Preferred modifiers include DMT, KS232, DPE, and stearamide wax with the wax most preferred.

Coat weight is 3.5#/ream.

TABLE 3

| | Dye 2 | Dye 6 | Dye 5 | Dye 4 | Dye 3 | Dye 1 | Dye 7 |
|---|---|---|---|---|---|---|---|
| 44DDS | 2.1 | 2.7 | 2.5 | 2.1 | 2.4 | 1.7 | 0.0 |
| 33DDS | 1.7 | | | | 1.0 | 0.2 | 0.0 |
| 44DDS/WAX | 2.6 | 2.7 | 2.7 | 2.5 | 2.2 | 1.8 | 1.6 |
| 33DDS/WAX | 2.2 | 2.5 | 2.4 | 2.2 | 1.8 | 1.3 | 0.0 |
| 44DDS/DPE | 2.5 | 2.5 | 2.6 | 2.2 | 2.1 | 1.7 | 0.0 |
| 33DDS/DPE | 1.5 | 2.3 | 1.7 | 1.7 | 0.5 | 0.0 | 0.0 |
| 44DDS/DME | 2.6 | 2.4 | 1.8 | 2.1 | 1.9 | 1.0 | 0.0 |
| 33DDS/DME | 1.4 | 1.6 | 1.8 | 1.4 | 0.1 | 0.0 | 0.0 |
| 44DDS/DMT | 2.5 | 2.5 | 2.5 | 2.1 | 1.7 | 1.6 | 0.0 |
| 33DDS/DMT | 1.7 | 2.0 | 1.8 | 2.0 | 1.0 | 0.0 | 0.0 |
| [MODIFIER] | | | | | | | |

Conversion of Symbol Average to Symbol Grade

TABLE 4

| |
|---|
| 3.5<= A <=4.0 |
| 2.5<= B <3.5 |
| 1.5<= C <2.5 |
| 0.5< D <1.5 |
| F <0.5 |

Table 4 Groupings in Table 3 are shown by border (none, light, bold).

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Uses of singular terms such as "a," "an," are intended to cover both the singular and the plural, unless otherwise indicated herein or clearly contradicted by context. The terms "comprising," "having," "including," and "containing" are to be construed as open-ended terms. All references, including publications, patent applications, and patents, cited herein are hereby incorporated by reference. Any description of certain embodiments as "preferred" embodiments, and other recitation of embodiments, features, or ranges as being preferred, or suggestion that such are preferred, is not deemed to be limiting. The invention is deemed to encompass embodiments that are presently deemed to be less preferred and that may be described herein as such. All methods described herein can be performed in any suitable order unless otherwise indicated herein or otherwise clearly contradicted by context. The use of any and all examples, or exemplary language (e.g., "such as") provided herein, is intended to illuminate the invention and does not pose a limitation on the scope of the invention. Any statement herein as to the nature or benefits of the invention or of the preferred embodiments is not intended to be limiting. This invention includes all modifications and equivalents of the subject matter recited herein as permitted by applicable law. Moreover, any combination of the above-described elements in all possible variations thereof is encompassed by the invention unless otherwise indicated herein or otherwise clearly contradicted by context. The description herein of any reference or patent, even if identified as "prior," is not intended to constitute a concession that such reference or patent is available as prior art against the present invention. No unclaimed language should be deemed to limit the invention in scope. Any statements or suggestions herein that certain features constitute a component of the claimed invention are not intended to be limiting unless reflected in the appended claims.

What is claimed is:

1. A thermally-responsive record material, substantially free of aromatic isocyanate, the record material comprising a support having provided thereon a heat-sensitive composition comprising:

a substantially colorless dye precursor comprising a fluoran;

a developer material selected from the group consisting of 4,4'-diaminodiphenylsulfone and 3,3'-diaminodiphenylsufone, which upon being heated react with said dye precursor to develop color;

a modifier compound which is a fatty acid amide;

and a binder material.

2. The thermally-responsive record material according to claim 1 wherein the fatty acid amide is selected from an alkyl amide, a bis methylene alkyl-amide, and a bis ethylene alkyl amide.

3. The thermally-responsive record material according to claim 1 wherein the modifier compound is a fatty acid amide selected from

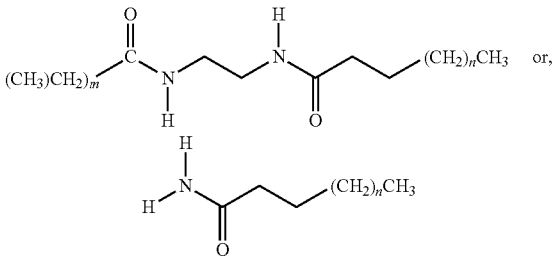

or, wherein m is 1 to 23, n is 0 to 21.

4. The thermally-responsive record material according to claim 1 wherein the fatty acid amide is selected from the group consisting of stearamide, lauramide, myristamide, and palmitamide.

5. The thermally-responsive record material according to claim 1 wherein the fatty acid amide is selected from the group consisting of palmitoleamide, oleamide, and linoleamide.

6. The thermally-responsive record material according to claim 1 wherein the fatty acid amide is selected from stearamide and methylene bis stearamide.

* * * * *